United States Patent [19]

Vakil

[11] 4,283,919

[45] Aug. 18, 1981

[54] VAPOR COMPRESSION CYCLE DEVICE WITH MULTI-COMPONENT WORKING FLUID MIXTURE AND METHOD OF MODULATING THE THERMAL TRANSFER CAPACITY THEREOF

[75] Inventor: Himanshu B. Vakil, Schenectady, N.Y.

[73] Assignee: General Electric Company, Schenectady, N.Y.

[21] Appl. No.: 52,971

[22] Filed: Jun. 28, 1979

[51] Int. Cl.[3] ..... F25B 1/00

[52] U.S. Cl. ..... 62/114; 62/115; 62/502; 237/2 B

[58] Field of Search ..... 62/114, 502, 503, 509, 62/512, 174, 120, 115; 237/2 B

[56] References Cited

U.S. PATENT DOCUMENTS

| | | | |
|---|---|---|---|
| 2,195,604 | 4/1940 | Taylor | 62/120 |
| 2,492,725 | 12/1949 | Ashley | 62/114 |
| 2,794,328 | 6/1957 | Herrick | 62/115 |
| 4,003,215 | 1/1977 | Roach | 62/476 |
| 4,179,898 | 12/1979 | Vakil | 62/114 |
| 4,217,760 | 8/1980 | Vakil et al. | 62/114 |
| 4,218,890 | 8/1980 | Vakil et al. | 62/114 |

*Primary Examiner*—Lloyd L. King
*Assistant Examiner*—Henry Bennett
*Attorney, Agent, or Firm*—Paul R. Webb, II; James C. Davis, Jr.

[57] ABSTRACT

A vapor compression cycle device includes a multi-component working fluid, a compressor, a condensing heat exchanger, a high-pressure accumulator and an evaporating heat exchanger assembly comprising a plurality of evaporator stages and a low pressure accumulator to enable the modulation of the capacity of the device to transfer heat. Means are provided to enable a rapid switching from device operation at high capacity to a lower capacity including the locating of the low pressure accumulator before a last stage of the evaporating heat exchanger in the working fluid flow path. The disclosed arrangement also includes means for avoiding the depletion of lubricating oil at the compressor during normal operation, as well as means for controlling the superheating of the working fluid.

18 Claims, 2 Drawing Figures

VAPOR COMPRESSION CYCLE DEVICE WITH MULTI-COMPONENT WORKING FLUID MIXTURE AND METHOD OF MODULATING THE THERMAL TRANSFER CAPACITY THEREOF

BACKGROUND OF THE INVENTION

This invention relates to vapor compression cycle devices, and more particularly to devices of such type which employ a multi-component working fluid mixture, and to a method of modulating the capacity of such devices to absorb and deliver heat.

Vapor compression cycle devices employing multi-component working fluids have been disclosed in the following copending patent applications, all of which are assigned to the same assignee as the present application: Ser. No. 926,510, filed July 20, 1978 now U.S. Pat. No. 4,217,760; Ser. No. 927,032, filed July 24, 1978 now U.S. Pat. No. 4,218,890; and Ser. No. 929,339, filed July 31, 1978 now U.S. Pat. No. 4,179,898. Each of these devices includes means to effect a modulation in device heating or cooling capacity in response to variations in demand. The present invention also includes means to modulate device capacity, and additionally, includes means for effecting a rapid transition from high to low capacity operation.

Each of the vapor compression cycle devices disclosed in the above-cited patents employs a multi-component working fluid mixture containing both low and high boiling point components and a pair of liquid accumulators connected through a flow restricting device to enable a modulation of device capacity. Due to equilibrium relationships between the working fluid vapor and liquid contained therein, the liquid in the first accumulator which flows from a condensing heat exchanger is enriched with the low boiling point component of the working fluid mixture, and the liquid in the second accumulator, which is connected to the inlet of a system compressor, is correspondingly enriched with the high boiling point component of the mixture. The capacity of the device to transfer heat is increased by adjusting the flow restricting device to allow a greater flow of the low boiling point component enriched liquid from the first accumulator to the second. The composition of the liquid in the second accumulator is thereby altered, resulting in a corresponding change in the vapor pressure or density at the compressor inlet. This accordingly increases the molar flow rate through the compressor (here in termed the flow rate of compression) which thereby increases the capacity of the device to absorb and deliver heat.

The capacity of each of the devices disclosed in the above cited patents is decreased by restricting the flow of liquid from the first accumulator to the second and by depleting the concentration of the low boiling point mixture component in the liquid contained in the second accumulator through evaporation. The evaporative process involves the transfer of heat from superheated vapor at the surface of the accumulator liquid. Although this process is effective, it requires an undesirably long time to switch from high to low capacity operation. For example, assuming a heat transfer coefficient of 20 BTU/hr ft$^2$° F., vapor superheat of 20° F., a refrigerant liquid density based on Freon-22 fluorocarbon refrigerant of 80 lbs/ft$^3$, and an evaporation enthalpy of 80 BTU/lb, an accumulator with a typical six inch head of fluid might require an eight hour switching time.

An additional problem common to many vapor compression cycle devices is the removal of lubricating oil from the compressor by the working fluid flowing therethrough, and the resultant collection of the oil in a liquid accumulator. More specifically, as the working fluid of a device circulates through a compressor it carries off lubricating oil in the form of oil mist through the compressor outlet. Additionally, provided sufficient temperature and pressure conditions are present, vaporized oil may be carried off by the working fluid. This removed oil collects in the liquid accumulator of the device, which can result in a depletion of compressor lubricating oil unless the oil-bearing liquid is recirculated. During the operation of the compressor, this depletion of oil is partly countered by the flow of working fluid which provides the compressor with a certain amount of lubrication. However, when the flow of fluid is interrupted such as during system startup, the lack of lubricating oil can cause serious compressor malfunctions.

Conventional vapor compression cycle devices have attempted to prevent compressor oil depletion by recirculating the oil-bearing accumulator liquid through the compressor. Inasmuch as the type of compressor typically employed in these devices operates to compress gases, it cannot accommodate the circulation of a substantial volume of liquid, which is relatively incompressable, without damaging the compressor. Accordingly, prior devices used to recirculate accumulator liquid and to thereby prevent oil depletion typically by limiting flow of oil-bearing liquid to the compressor to a trickle by including a specifically designed compressor inlet tube in the accumulator. The inlet tubes are in the form of a J-tube entering from above the accumulator, or a standpipe. In both types, an open end at the tube inlet extends into a vapor region of the accumulator, and a small aperture is provided below the level of the accumulator liquid to allow a limited amount of liquid to be extracted and sent directly to the compressor inlet admixed with working fluid vapor.

However, the modulation of capacity in a device as described above requires the varying of accumulator liquid level such that at a high liquid level corresponding to a high device capacity the liquid may overflow into the vapor inlet for the compressor, causing damage thereto as noted above. Conversely, a device operating at a low capacity could have a liquid level too low to allow the oil-bearing liquid to flow into the liquid extracting aperture in the compressor inlet tube. Thus, the conventional J-tube and standpipe designs do not present a practical solution to the oil depletion problem in capacity modulating devices such as those described in the above-cited patents.

Finally, a vapor compression cycle device should preferably have means to control evaporator superheat in order to improve the device performance. Superheat is the temperature of a vapor above that required for the evaporation thereof. A large superheat is often inefficient, and means for controlling it are required for optimal system performance.

Accordingly, it is an object of the present invention to provide a new and improved vapor compression cycle device.

Another object of the present invention is to provide a vapor compression cycle device including new and improved means for switching from high to low thermal capacity operation.

Another object of the present invention is to provide a new and improved vapor compression cycle device in which depletion of lubricating oil from the compressor is avoided.

Another object of the present invention is to provide a new and improved vapor compression cycle device which is adapted for enabling variable control of device capacity and of evaporator superheat.

Still another object of the present invention is to provide a new and improved method of operating a vapor compression cycle device whereby the time required to switch from a high device thermal transfer capacity to a low thermal transfer capacity is decreased, and evaporator superheat is controlled.

SUMMARY OF THE INVENTION

The above and other objects and advantages are achieved in a vapor compression cycle device employing a multi-component working fluid wherein the second of a pair of accumulators preceeds a final stage of an evaporating heat exchanger in the fluid circuit. This location of the second accumulator enables a rapid transition from high capacity to low capacity operation of the device. A method is also provided for predeterminately regulating fluid flow into the second accumulator from a first accumulator, and flow from the second accumulator to a final stage of an evaporator for thus controlling evaporator superheat and the capacity of the device to absorb and deliver heat.

BRIEF DESCRIPTION OF THE DRAWING

For a better understanding of the invention, reference may be had to the accompanying drawing wherein.

DESCRIPTION OF THE INVENTION

Figure 1:
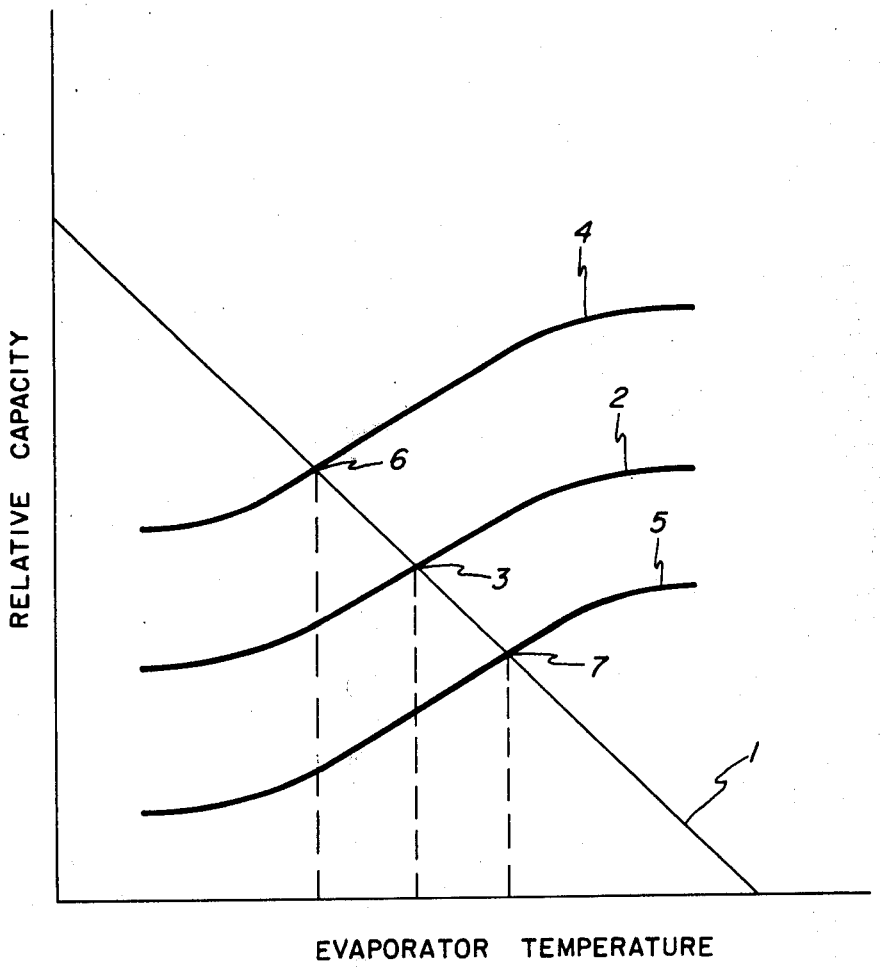
FIG. 1 is a schematic graph exhibiting a typical contrast between the thermal demand of a household and the heating capacity of a vapor compression cycle device operating in the heating mode as a function of evaporator temperature.

The heating and cooling capacity of a vapor compression cycle device such as a heat pump should ideally coincide with the heating and cooling demands of an associated household so as to avoid the inefficiencies attendant the use of a device having either excess or insufficient capacity. Accordingly, since the heating and cooling demands of a household vary with climatic conditions, an ideal device would have a correspondingly variable capacity in order to obtain optimal performance. For example, as the thermal demands of a household increase with decreasing outdoor temperatures as depicted by line 1 in FIG. 1, the capacity of an associated device should desirably increase as well. Unfortunately, as illustrated by line 2 of FIG. 1, the capacity of a typical vapor compression cycle devices does not vary with temperature as does household thermal demand, and indeed household demand and device capacity are matched at only a single point 3. The present invention, however, enables the capacity of a vapor compression cycle device to be modulated within a broad range as represented by lines 4 and 5 to accommodate changes in household thermal demand. Thus, optimal device performance in which device capacity and household demand are balanced can be achieved over a wider temperature range as illustrated by points 6 and 7 in FIG. 1.

Figure 2:
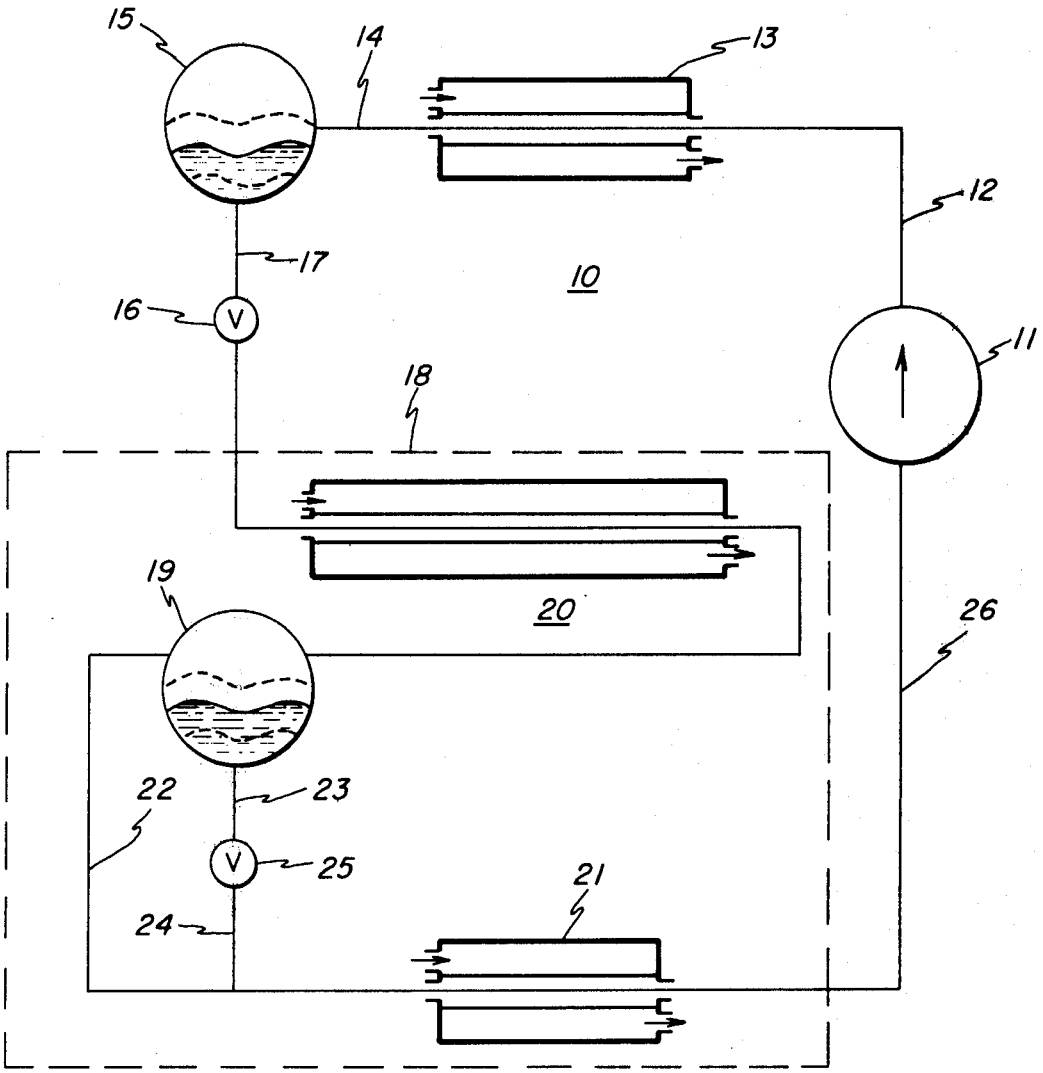
FIG. 2 is a schematic illustration of a vapor compression cycle device constructed in accordance with an embodiment of the present invention.

This modulation of device capacity is effected in a vapor compression cycle device 10 constructed in accordance with an embodiment of the present invention as illustrated in FIG. 2. Although not limited thereby, the device 10 as described herein below is adapted for a heating mode of operation. However, it is to be understood that such a device can also be operated to meet the cooling requirements of a household.

The device 10 is a closed cycle device in which a working fluid is circulated by a compressor 11 through a tube 12 to a condensing heat exchanger 13. After transferring its heat in the condensor 13 to the household, the working fluid flows through a tube 14 to a high pressure accumulator 15. The accumulator 15 is connected to a flow restricting device 16 which is an expansion valve in the preferred embodiment of this invention. The valve 16 controls the amount of the working fluid allowed to flow through a tube 17 to an evaporator assembly 18 where heat is absorbed. The evaporator assembly 18 includes a low pressure accumulator 19 connected intermediate a first evaporator stage 20 and a second evaporator stage 21. Thus, the working fluid entering the evaporator assembly from the expansion valve 16 flows through the first evaporator stage 20 to the low pressure accumulator 19 from which it then flows through lines 22, 23 and 24 and an associated valve 25 to the second evaporator stage 21. Tube 26 connects the outlet side of the evaporator assembly to the inlet of the compressor 11 to effect a closed system.

The working fluid circulated in this closed system is a multi-component mixture of fluids which have different vapor pressures and which are miscible over the operative range of the device 10. In the preferred embodiment, the working fluid is a multi-component fluorocarbon mixture. Such multi-component fluorocarbon mixtures can be selected, for example, from those disclosed in U.S. Pat. No. 4,003,215 issued Jan. 18, 1977, to John Roach.

The modulation of the capacity of the device 10 is accomplished by altering the density of the working fluid vapor at the inlet of the compressor 11. This effectively varies the molar flow rate through the compressor (i.e., the flow rate of compression), thereby affecting the capacity of the device 10 to transfer heat to an associated household. The compressor inlet density is dependent upon the vapor pressure thereat which is a function in part of the composition of the working fluid liquid collected in the low pressure accumulator 19. If the composition of this accumulator liquid is enriched with a low boiling point component of the working fluid mixture, the pressure in the accumulator 19, and thus the compressor suction pressure, is increased, which ultimately increases the molar flow rate, and hence increases the capacity of the device 10 to absorb and deliver heat. Conversely, a decrease in the concentration of the low boiling point component in the liquid contained in the low pressure accumulator 19 will effect a decrease in the compressor suction pressure, and hence in the capacity of the device to absorb and deliver heat.

The changing of the concentrations of the components of the liquid composition in the accumulator 19 is accomplished in part by adjusting the rate of flow from the accumulator 15. The high pressure accumulator 15 normally includes a higher concentration of the working fluid low boiling point component than does the liquid in the low pressure accumulator 19 due to the equilibrium relationships between vapor and liquid mixtures therein. Thus, to increase the capacity of the device 10 to transfer heat, the valve 16 is adjusted to augment the flow from the accumulator 15 such that the liquid level in the low pressure accumulator 19 is increased and the composition of the mixture therein is enriched with the low boiling point component of the working fluid. This then causes an increase in the compressor inlet density, and thus increases the capacity of the device to absorb and deliver heat.

In order to decrease device capacity upon increased evaporator temperature and associated decreased household thermal demand, the steps described above are reversed. To this end, the flow of the working fluid liquid from the accumulator 15 to the low pressure accumulator 19 is restricted by adjusting the valve 16. The low boiling point component in the liquid contained in the low pressure accumulator 19 is slowly depleted through evaporation by means of heat transfer from the vapor interfacing therewith. However, as noted above, the depletion of the liquid contained in the low pressure accumulator 19 through this evaporative process requires a long time constant.

To accomplish a more rapid transition from a high to a low capacity mode of operation, the present invention as illustrated in FIG. 2 includes tubes 23 and 24 and a valve 25 which connect the liquid region of the accumulator 19 with the second evaporator stage 21. Thus, upon decreased thermal demand the valve 25 is opened a predetermined amount to allow a portion of the liquid in the accumulator 19 to flow into the second evaporator stage 21 along with working fluid vapor flowing through the tube 22. The mixture is therein vaporized prior to entering the compressor inlet through the tube 26. In this manner, the time required to deplete the liquid level in the low pressure accumulator 19, and thus to decrease the thermal transfer capacity of the device 10, is significantly reduced from that required in prior devices.

The length of time required to accomplish this decrease in device capacity is a function of several variables including the relative position of the low pressure accumulator 19 within the evaporator assembly 18. In the preferred embodiment of this invention, the accumulator 19 is located in the fluid circuit such that the second evaporator stage 21 comprises no more than 20% of the total evaporator area. While in principle this invention will also function with a second evaporator stage in excess of 20% of the total evaporator area, such an increase in second evaporator stage capacity will cause a decrease in the capacity range over which the device can be modulated. Accordingly, the time constant required to accomplish the complete evaporation of the liquid in the low pressure accumulator 19 of a device constructed in accordance with the preferred embodiment would be approximately 5 minutes based on the following conservative assumptions: Total evaporator capacity is 10,000 BTU/hr; total accumulator charge is 2 lbs; and evaporation enthalpy is 80 BTU/lb. This represents a significant reduction in the switching time from high to low capacity as compared to the 8 hour switching time in the example cited above.

Additionally, the location of the low pressure accumulator in a flow path preceding the final evaporator stage allows a substantial quantity of liquid to flow out of the accumulator 19 while still avoiding the problems noted above which result from substantial quantities of liquid flowing into the compressor. In the present invention, the liquid flowing through the tube 23 is evaporated in the second stage evaporator 21, and thus enters the compressor 11 as a vapor rather than as a liquid.

The control valve 25 in the present invention can be regulated to allow a predetermined amount of liquid to flow from the accumulator 19 to avoid the depletion of lubricating oil from the compressor 11. This is accomplished in spite of the variable liquid levels in the accumulator 19 which are required for capacity modulation, and which previously barred the use of such oil depletion devices as J-tubes and standpipes as noted above.

Furthermore, the liquid control valve 25 provides a means to control evaporator superheat through the regulation of the amount of liquid flowing therethrough. Thus, the present system contains an additional control variable to achieve a simultaneous control of device capacity and of evaporator superheat.

More specifically, the method of increasing the capacity of the device 10 to absorb and deliver heat according to a first embodiment of this invention includes the adjusting of the valve 16 to augment the flow of liquid from the high pressure accumulator 15 to the low pressure accumulator 19, and the restricting of liquid flow from the accumulator 19 by adjusting the valve 25. To decrease the thermal capacity of the device 10, the liquid flow from the accumulator 15 is restricted by adjusting the valve 16, and the flow of liquid from the low pressure accumulator 19 is increased by opening the valve 25. Liquid flowing from the accumulator 19 through the valve 25, enters the second stage evaporator 21 and is therein vaporized prior to entering the inlet of the compressor 11 through the tube 26. The valve 25 is also adapted for the regulation of evaporator superheat at the exhaust of the second stage evaporator 21. More specifically, the valve 25 can be adjusted to increase or decrease the flow of liquid therethrough to correspondingly increase or decrease the temperature and the accompanying liquid content of the vapor exiting the second evaporator stage 21 and entering the compressor 11 through the tube 26.

In an alternative embodiment of the present invention the flow restricting device 16 is a non-adjustable element such as a capillary tube. Accumulator liquid levels and the associated levels of device capacity are modulated by adjusting the valve 25.

More specifically, the capacity of the device 10 to absorb and deliver heat is decreased according to this alternative embodiment by opening the valve 25, causing the liquid level in the accumulator 19 to lower and resulting in a decreased molar flow rate through the compressor 11. An associated decrease in pressure in the accumulator 15 results in a lower flow rate consistent with a new lower device capacity through flow restricting device 16. More particularly, changes in the flow rate through the non-adjustable flow restricting device 16 are predominantly dependent on upstream pressure, such that decreased pressure in the accumulator 15 results in a lower steady-state flow rate to the evaporator assembly 18. Device capacity is similarly increased in this alternative embodiment by adjusting the valve 25 to increase the liquid level in the accumulator 19. Control of evaporator superheat and compressor lubricating oil-depletion prevention are achieved as in the embodiment described above through the adjustment of the valve 25 to control the liquid flow therethrough.

This alternative embodiment contains many of the benefits of the preferred embodiment, but is somewhat slower to respond to changes in demand. This results from the delay required for the device to achieve steady state equilibrium conditions without the intervention of an adjustably variable flow restricting device. However, the use of a non-adjustable flow restricting device results in a simpler variable capacity vapor compression cycle device.

The above-described embodiments of this invention are intended to be exempletive only and not limiting, and it will be appreciated from the foregoing by those skilled in the art that many substitutions, alterations and changes may be made to the disclosed structures and methods without departing from the spirit or the scope of the invention.

What is claimed as new and desired to be secured by Letters Patent of the United States is:

1. A method of modulating the thermal transfer capacity and the evaporator superheat of a vapor compression cycle device which includes compressing a multi-component working fluid mixture, comprising at least two miscible refrigerants having different boiling points condensing a vapor portion of the mixture, storing a liquid portion of the mixture under high pressure, controlling the flow rate of the mixture from high pressure storage, evaporating a portion of the mixture liquid flowing from storage, storing the remaining unevaporated mixture under low pressure, combining at least a portion of the evaporated mixture and a controlled amount of the stored unevaporated mixture portion, evaporating the combined mixture, and controlling the flow rate of compression by the density of the working fluid mixture entering therein.

2. A vapor compression cycle device for circulating a multi-component working fluid comprising at least two miscible refrigerants having different boiling points in a closed working fluid circuit said device including;

a compressor in flow communication with a condensing heat exchanger; and a first accumulator means in flow communication with the said condensing heat exchanger and in flow communication with an evaporator assembly;

said evaporator assembly comprising first and second evaporator stages and a second accumulator means in flow communication with said first evaporator stage and in adjustably variable flow communication with said second evaporator stage, with said second evaporator stage in flow communication with said compressor.

3. A vapor compression cycle device as in claim 2 wherein said first accumulator means is in adjustably variable flow communication with said evaporator assembly.

4. A method of modulating the thermal transfer capacity and the evaporator superheat of a vapor compression cycle device which includes compressing a multi-component working fluid mixture, comprising at least two miscible refrigerants having different boiling points circulating the mixture to a condensing heat exchanger, circulating the condensed mixture from the condensing heat exchanger to a high pressure accumulator, circulating a portion of the mixture from the high pressure accumulator to a first evaporator stage, circulating the mixture from the first evaporator stage to a low pressure accumulator, controlling the circulation of mixture liquid from the low pressure accumulator to a second evaporator stage, circulating mixture vapor from the low pressure accumulator to the second evaporator stage, circulating the mixture from the second evaporator stage to a compressor, and controlling the flow rate of compression by density of the mixture entering therein.

5. A method of modulating the thermal transfer capacity and the evaporator superheat of a vapor compression cycle device as in claim 4 in which the flow of the working fluid mixture liquid from the low pressure accumulator to the second evaporator stage is increased to decrease device thermal transfer capacity.

6. A method of modulating the capacity and the evaporator superheat of a vapor compression cycle device as in claim 4 in which the flow of the working fluid mixture liquid from the low pressure accumulator to the evaporator second stage is increased to decrease evaporator superheat of the mixture circulated to the compressor.

7. A method of modulating the capacity and the evaporator superheat of a vapor compression cycle device as in claim 4 in which the circulation of mixture from the high pressure accumulator to the first stage evaporator is variably controlled.

8. A method of modulating the thermal transfer capacity and the evaporator superheat of a vapor compression cycle device as in claim 7 in which the flow of the working fluid mixture from the high pressure accumulator to the evaporator first stage is reduced to decrease device thermal transfer capacity.

9. A vapor compression cycle device for circulating a multi-component working fluid comprising at least two miscible refrigerants having different boiling points in a closed working fluid circuit said device including;

a compressor means, a condensing heat exchanger in flow communication with an outlet of the compressor means, a first accumulator means having an inlet in flow communication with the condensing heat exchanger, an expansion device in flow communication with an outlet of the first accumulator means, and an evaporator assembly including a first evaporator stage having an inlet in flow communication with the expansion device, a second evaporator stage having an outlet in flow communication with an inlet of the compressor means, a second accumulator means disposed in flow communication intermediate the first and second evaporator stages and means for adjustably varying the working fluid flow from the second accumulator means to the second evaporator stage.

10. A vapor compression cycle device as in claim 9 wherein the means for varying the working fluid flow from the second accumulator comprises means to adjustably vary the quantity of working fluid in a liquid phase flowing from the second accumulator means to the second evaporator stage.

11. A vapor compression cycle device as in claim 9 wherein the second accumulator means includes an upper vapor bearing region and a vertically lower liquid bearing region, and said flow communication between the second accumulator means and the second evaporator stage includes first and second tube assemblies connecting the upper and lower second accumulator regions respectively with the second evaporator stage.

12. A vapor compression cycle device as in claim 9 wherein said second tube assembly includes a flow restricting device disclosed intermediate said second accumulator and said second evaporator stage.

13. A vapor compression cycle device as in claim 9 wherein the first accumulator means is in adjustably variable flow communication with the inlet of the expansion device.

14. A method of modulating the thermal transfer capacity and evaporator superheat of a vapor compression cycle device in which a vapor phase of a working fluid mixture which comprises at least two miscible refrigerants having different boiling points is compressed and condensed, condensed mixture is selectively stored under high pressure, at least a portion of the condensed mixture is expanded, and in which the expanded mixture is recycled for compression by;

evaporating a portion of the expanded mixture;

selectively storing unevaporated expanded mixture under low pressure;

selectively withdrawing unevaporated mixture from low pressure storage in order to modulate device thermal transfer capacity and evaporator superheat;

combining remaining unstored unevaporated mixture, the evaporated mixture, and any mixture selectively withdrawn from low pressure storage; and evaporating the combined mixture and recycling the resulting evaporated mixture for compression.

15. A method as in claim 14 in which substantially all of the unevaporated expanded mixture is stored under low pressure and device thermal transfer capacity and evaporator superheat are modulated by selectively withdrawing different amounts of unevaporated mixture from low pressure storage.

16. A method as in claim 14 in which the amount of the unevaporated mixture withdrawn from low pressure storage is increased to decrease device thermal transfer capacity.

17. A method as in claim 14 in which the amount of the unevaporated mixture withdrawn from low pressure storage is increased to decrease evaporator superheat of the mixture recycled for compression.

18. A method as in claim 14 in which the amount of condensed mixture stored under high pressure is increased to decrease device thermal transfer capacity.

* * * * *